US006273734B1

(12) United States Patent
Ikeda et al.

(10) Patent No.: US 6,273,734 B1
(45) **Date of Patent: *Aug. 14, 2001**

(54) ELECTRONIC DEVICE WITH AC PLUG

(75) Inventors: Akihiro Ikeda; Hidetoshi Hamai, both of Iizuka (JP)

(73) Assignee: Mitsumi Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/329,166

(22) Filed: Jun. 9, 1999

(30) Foreign Application Priority Data

Jan. 28, 1999 (JP) ..... 11-020467

(51) Int. Cl.[7] ..... H01R 13/44
(52) U.S. Cl. ..... 439/131; 439/174
(58) Field of Search ..... 439/131, 956, 439/172, 171, 173, 174

(56) References Cited

U.S. PATENT DOCUMENTS 4,467,263 * 8/1984 Conforti et al. ..... 320/2
5,545,047 * 8/1996 Okada et al. ..... 439/157
5,628,641 * 5/1997 Hahn ..... 439/131
5,755,582 * 5/1998 Charlton ..... 439/131
5,967,807 * 10/1999 Wu ..... 439/131
6,093,038 * 7/2000 Chen et al. ..... 439/131

* cited by examiner

*Primary Examiner*—Brian Sircus
*Assistant Examiner*—Son V. Nguyen
(74) *Attorney, Agent, or Firm*—Ladas & Parry

(57) ABSTRACT

An AC adapter (electronic device) comprises a coil spring (elastic member), an engagement member, and an AC plug in which a guide groove is formed in a holding portion thereof. One end portion of the coil spring is fixed in the holding portion, and the other end portion of the coil spring is fixed in a case. One end portion of the engagement member is engaged with the guide groove of the holding portion. The engagement place of the one end portion of the engagement member and the fixation place of the one end portion of the coil spring sandwich a central axis of a rotary shaft and are symmetric with respect to the central axis. The other end portion of the engagement member is engaged with a hole portion formed in the case. The guide groove engaged with the one end portion of the engagement member is shaped like a heart so as to rotate the AC plug. A heart-shaped concave portion of the guide groove functions as a fixing groove portion for temporarily fixing the AC plug in a position where the AC plug is rotated nearly 90 degrees.

9 Claims, 7 Drawing Sheets

ELECTRONIC DEVICE WITH AC PLUG

BACKGROUND OF THE INVENTON

1. Field of the Invention

The present invention relates to an electronic device with an AC plug and more particularly to an electronic device with an AC plug in which the AC plug to be connected to a power supply is mounted so as to be able to rotate 90 degrees so that the AC plug can be stored in a case of the electronic device.

2. Description of the Related Art

Conventionally, electronic devices such as, for example, a charger for charging a battery, an AC adapter for converting an AC power supply to a working voltage or to a DC power supply, and the like, are well known.

These electronic devices are each equipped with an AC plug which has blades for connecting the AC plug to a power supply and a holding portion integrally formed on end portions of the blades. In order to improve miniaturization and portability of the electronic device, the AC plug is designed to be a falling-type AC plug which can be rotated 90 degrees about a case (device body) so that the AC plug can be stored in the case.

There are two AC adapters shown in FIGS. 6 and 7 as examples of the above-mentioned electronic device.

FIG. 6*a* is a schematic front view of a first AC adapter 1. FIG. 6*b* is a cross-sectional view taken along a line a—a of FIG. 6*a* of the AC adapter 1. The AC adapter 1 comprises a case 2 formed of insulation resin and an AC plug 3. The AC plug 3 consists of a pair of blades 4*a,* 4*b* formed of conductive metal material, and a holding portion 5 molded out of resin material and integrated with end portions of the blades 4*a,* 4*b*.

A rotary shaft 6 extends out of the holding portion 5 of the AC plug 3 and a bearing portion 7 for supporting the rotary shaft 6 is formed in the case 2. In FIG. 6*a,* as shown by an arrow, the AC plug 3 is designed to be able to rotate 90 degrees about the rotary shaft 6. The angle of 90° is from a position where the AC plug 3 is stored in the case 2 (see lines formed by alternate long and two short dashes), to a position where the AC plug 3 is raised upright from the case 2 (see continuous lines) for connecting to a power supply (not shown). In addition, on an end surface of the holding portion 5 of the AC plug 3, there are contact portions of the blades 4*a,* 4*b* to be connected to the power supply and contacts in connection with a substrate (not shown) within the case 2. When the AC plug 3 is rotated, the contact portions and the contacts are in flexible connection with each other, and a description thereof is omitted (hereinafter, the description of the contact portions and the like in an embodiment of the present invention will also be omitted).

In the above-mentioned AC adapter 1, the blades 4*a,* 4*b* of the AC plug 3 sandwich the central axis of the shaft portion 6 and are mounted with broad portions thereof facing each other. On the other hand, in a second AC adapter 8, as shown in FIG. 7, which basically comprises the same elements (the corresponding elements are given the same reference numerals), each of the blades 4*c,* 4*d* of the AC plug 3 is mounted so as to lie in a plane perpendicular to the central axis of the shaft portion 6, with the broad portions of the blades 4*c,* 4*d* facing each other.

In the conventional AC adapter 1 or 8 in which the AC plug 3 can be rotated and stored therein, the AC plug 3 is fixed (locked) in a state in which the AC plug 3 is raised from the case 2 by a rotation of 90 degrees (a raised state) by, for example, a fixing mechanism which consists of a projection and a hole portion (not shown).

However, in the conventional adapters 1 or 8, if the AC plug 3 fixed by the fixing mechanism collides with some object, the fixed AC plug 3 may be damaged by a force caused by the collision.

SUMMARY OF THE INVENTION

It is a general object of the present invention to provide an electronic device with an AC plug, in which the above disadvantage can be eliminated.

A more specific object of the present invention is to provide an electronic device with an AC plug, in which the AC plug, in a state of having been raised from a case, will not be damaged even if the electronic device collides with some object.

According to one aspect of the present invention, there is provided an electronic device with a falling-type AC plug which can be rotated 90 degrees. The electronic device comprises a force mechanism for constantly exerting a force on the AC plug so that the AC plug can be stored in a case of the device, and a fixing mechanism for temporarily fixing the AC plug when the AC plug is raised by a rotation of nearly 90 degrees, the AC plug being released from the temporarily fixed state when the AC plug is connected to and then removed from a power supply.

Herein, the rotation angle of 90° supports a connection angle at which the AC plug is connected to a power supply. In general, the connection angle is usually set at 90 degrees. However, the connection angle may be set at 45 degrees in place of 90 degrees in a special case in which the AC plug is connected to a power supply at an angle of 45°. At a rotation angle of nearly 90°, the AC plug may be smoothly connected to a power supply. Further, since the AC plug is raised by a rotation of nearly 90 degrees against the force exerted by the force mechanism, after the AC plug is connected to and then removed from the power supply, the AC plug automatically rotates back so as to be stored in the case. Thus, the AC plug is prevented from becoming damaged from a collision with an object.

According to the above-mentioned structure of the present invention, the AC plug stored in the case of the electronic device is raised by a rotation about a rotary shaft against a force exerted by the force mechanism. When the AC plug is rotated nearly 90 degrees, the AC plug is temporarily fixed by means of the fixing mechanism mounted in a predetermined position. The fixing mechanism includes, for example, an engagement portion which consists of a hemispherical projection and a hole portion corresponding to the projection. The AC plug in the temporarily fixed state is connected to a power supply, and thereby the AC plug is completely rotated 90 degrees, and then the electricity is turned on. After that, if the AC plug is removed from the power supply, the AC plug will rotate back so as to be stored in the case rather than be temporarily fixed, because the force mechanism exerts a pulling force on the AC plug larger than that of a fixing force exerted on the AC plug by the fixing mechanism.

Accordingly, when the AC plug is not to be connected to a power supply, the AC plug is always stored in a case, and therefore the AC plug will not damaged even if the electronic device collides with some object.

According to another aspect of the present invention, an electronic device comprises a case; an AC plug having blades for connecting to a power supply and a holding portion integrally formed on end portions of the blades, the AC plug being designed to be able to rotate 90 degrees about the case so as to store the AC plug in the case; an elastic member having two end portions, one end portion being fixed in the holding portion of the AC plug, the other end portion being fixed in the case, wherein when the AC plug is raised by a rotation of 90 degrees about a rotary shaft, the elastic member extends perpendicular to a central axis of the rotary shaft and is positioned nearer to an opening end surface formed on the case for raising up the AC plug than the central axis so as to exert a torque on the AC plug about the rotary shaft; a guide groove for guiding the AC plug so that the AC plug can rotate 90 degrees, the guide groove having a fixing groove portion for temporally fixing the AC plug in a position where the AC plug is rotated nearly 90 degrees; and an engagement member having two end portions for engaging the holding portion of the AC plug with the case, one end portion being engaged with the guide groove of the AC plug, the other end portion being engaged with a hole portion formed in the case, wherein when the AC plug is raised up from the case, the elastic member is stretched and the engagement member is guided to the fixing groove portion via the guide groove, the AC plug being temporarily fixed at the position where the AC plug is rotated nearly 90 degrees, when the AC plug is connected to a power supply and the AC plug is completely rotated 90 degrees, the engagement member is guided by the guide groove and thereby the fixation of the AC plug is released, when the AC plug is removed from the power supply, the elastic member contracts and the engagement member is guided by the guide groove so that the AC plug can be automatically stored in the case. Hence, the present invention can achieve improved effects by the above-mentioned structure thereof.

BRIEF DESCRIPTION OF THE DRAWINGS

Further objects and advantages of the present invention can be more fully understood from the following detailed description, in conjunction with the accompanying drawings, in which.

DETAILED DESCRIPTION OF THE PREFERRED EMBODIMENT

Figure 1:
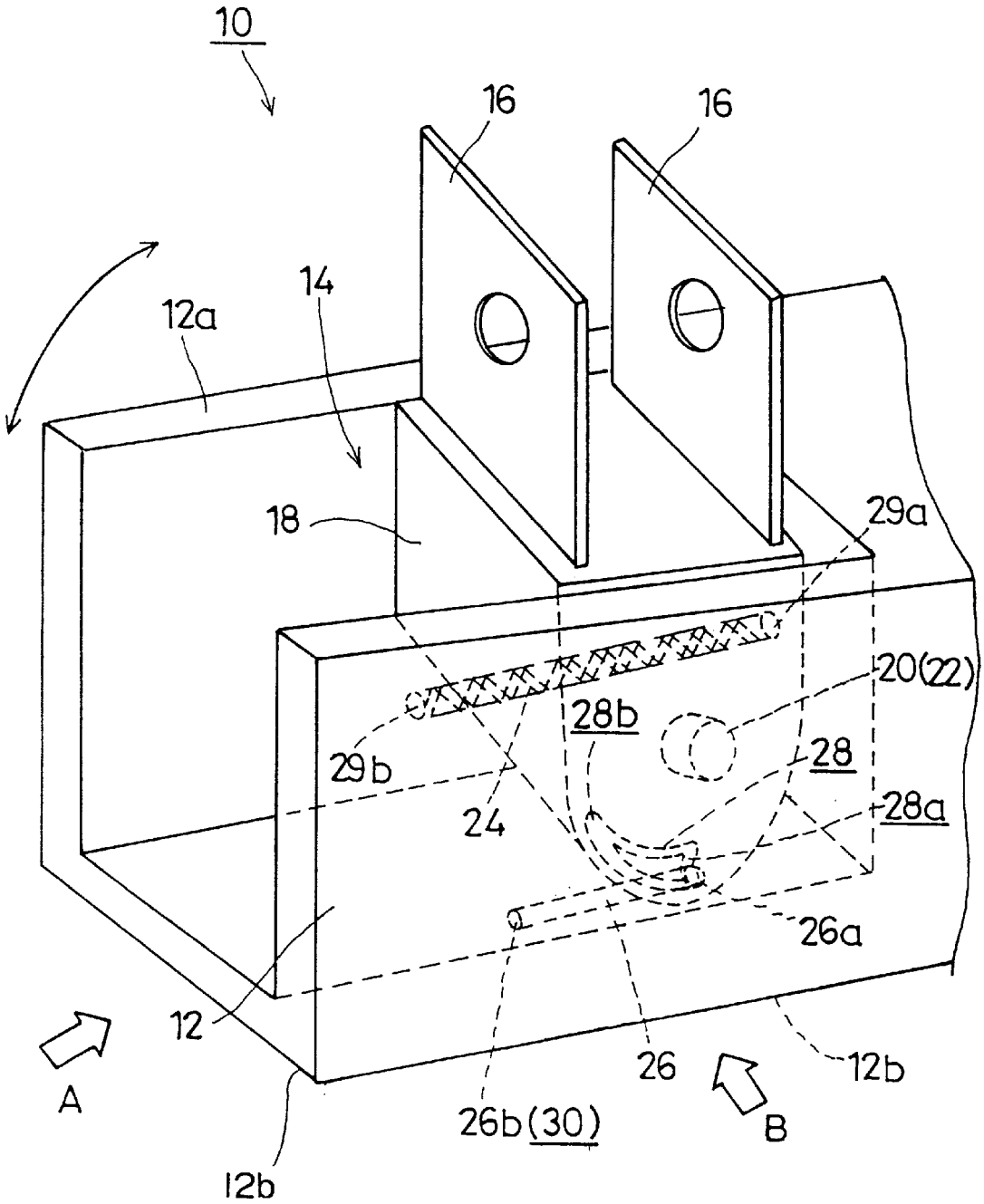
FIG. 1 is a perspective view of an AC adapter according to an embodiment of the present invention.
Figure 2:
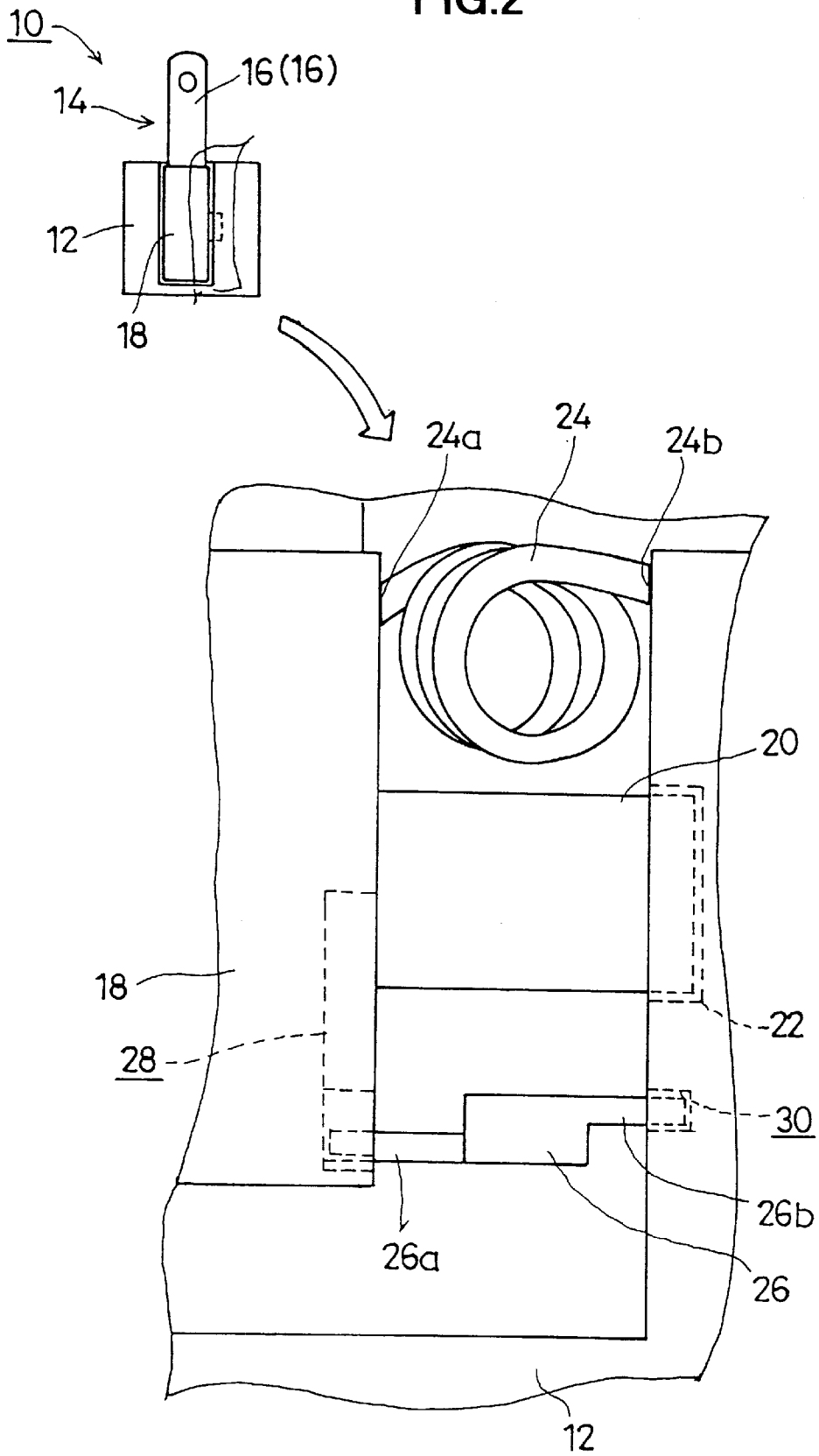
FIG. 2 shows a view of the AC adapter seen from an "A" direction of FIG. 1 and a partly enlarged view thereof.
Figure 3:
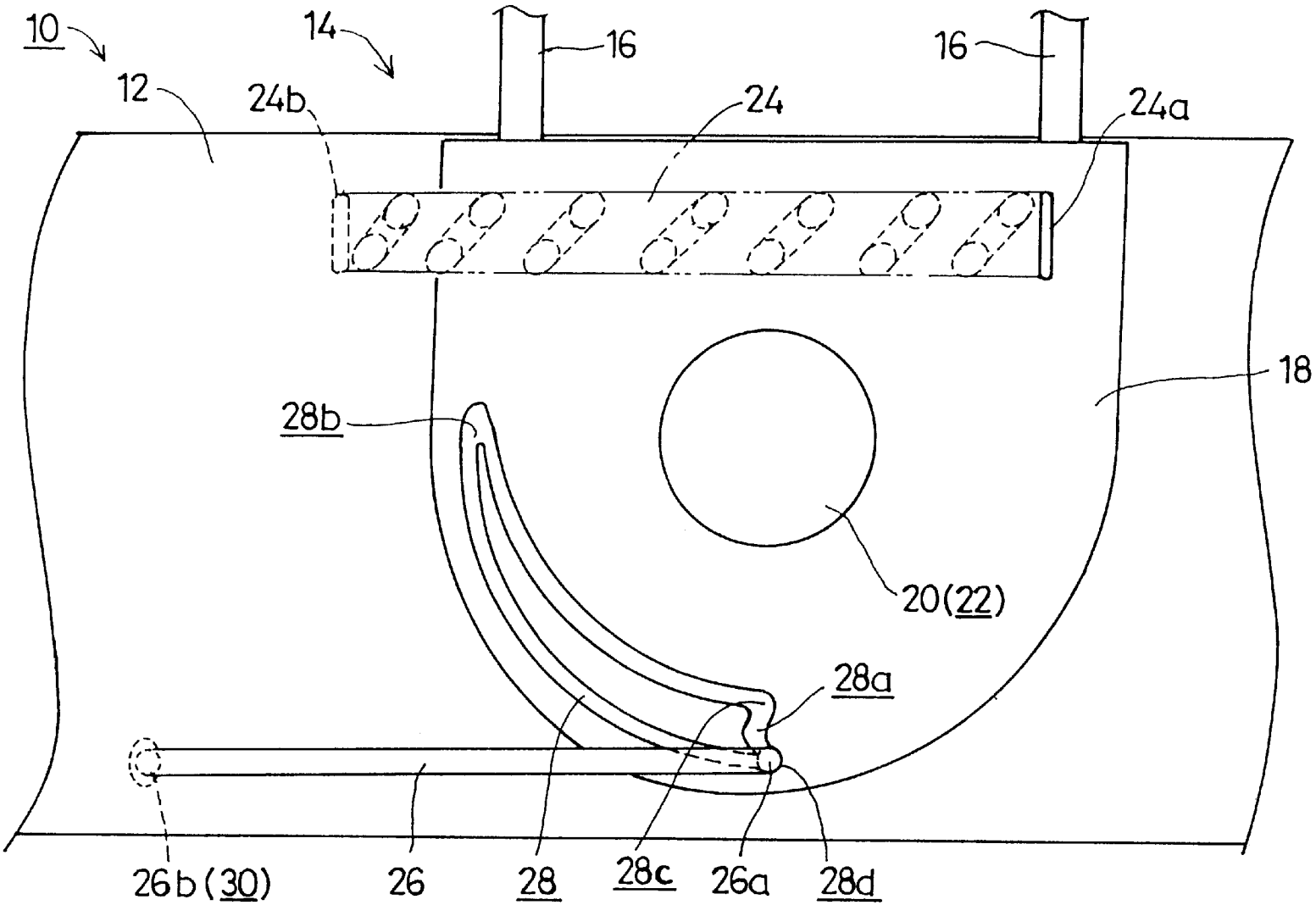
FIG. 3 is an enlarged view of the AC adapter seen from a "B" direction of FIG. 1.

FIGS. 1 to 3 show an AC adapter 10 as an electronic device with an AC plug according to an embodiment of the present invention. The AC adapter 10 comprises a case 12 and an AC plug 14. The AC plug 14 consists of a pair of blades 16 and a holding portion 18 which is formed integrally on end portions of the blades 16. A rotary shaft 20 extends out of the holding portion 18 of the AC plug 14, and a bearing portion 22 for supporting the rotary shaft 20 is formed in the case 12. The AC plug 14 is designed to be able to rotate 90 degrees, from a position of being stored in the case 12 (see FIG. 4*a*) to a position of being raised upright from the case 12 (see FIGS. 1 to 3) so as to connect to a power supply (not shown).

The AC adapter 10 further comprises a coil spring (force mechanism or elastic member) 24 and an engagement member 26. A guide groove 28 is formed in the holding portion 18 of the AC plug 14.

The coil spring 24 has one end portion 24*a* which is fixed in the holding portion 18 of the AC plug 14 and the other end portion 24*b* which is fixed in the case 12. In a case in which the AC plug 14 is raised upright by rotating an angle of 90° (see FIGS. 1 and 3), the coil spring 24 extends perpendicular to the central axis of the rotary shaft 20 and is positioned nearer to an opening end surface 12*a* formed in the case 12 for raising the AC plug 14 than the central axis of the rotary shaft 20. That is, in this case, the two end portions 24*a*, 24*b* of the coil spring 24 are positioned nearly the opening end surface 12*a*.

The engagement member 26 has two end portions 26*a*, 26*b*. The end portion 26*a* is engaged with the guide groove 28 which is formed in the holding portion 18 and extends perpendicular to the central axis of the rotary shaft 20. The place in which the guide groove is formed and the place in which the end portion 24*a* of the coil spring 24 is fixed, sandwich the central axis of the rotary shaft 20 and are approximately symmetric with respect to the central axis of the rotary shaft 20. The end portion 26*b* is engaged with a hole portion 30 which is formed nearly an end surface 12*b* opposite to the opening end surface 12*a* of the case 12.

The guide groove 28 is shaped like a heart (a heart-cam mechanism) so as to make the AC plug 14 rotate while engaging with the end portion 26*a* of the engagement member 26. The heart-shaped guide groove 28 has a heart-shaped concave portion 28*a*, as described later, functions as a fixing groove portion (a fixing mechanism) for temporarily fixing the AC plug 14 when the AC plug is raised to be nearly a position in which the AC plug 14 is to be connected to a power supply (position of rotating an angle of 90°).

A description will be given of actions of the AC adapter 10 as described above according to the embodiment of the present invention, in conjunction with FIG. 4.

Figure 4A:
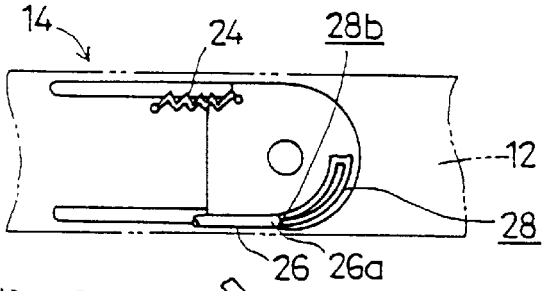
FIGS. 4*a* to 4*f* show structures and actions of the AC adapter according to the embodiment of the present invention, in order from FIG. 4*a* showing an AC plug of the AC adapter stored in a case, to FIG. 4*f* showing the AC plug of the AC adapter being stored in the case again.

In FIG. 4*a*, when the AC plug 14 of the AC adapter 10 is completely stored in the case 12, the coil spring 24 is in a most contracted state. At this time, the end portion 26*a* of the engagement member 26 is engaged with a convex portion 28*b* of the guide groove 28.

Figure 4B:
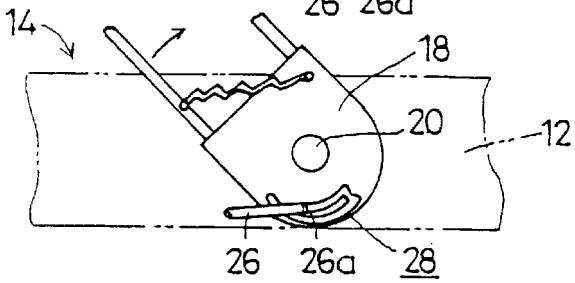

In FIG. 4*b*, while the AC plug 14 is raised up from the case 12 following an arrow, the coil spring 24 is stretched gradually with rotation of the holding portion 18 about the rotary shaft 20. At the same time, the end portion 26*a* of the engagement member 26 is guided along a upper-middle groove portion of the guide groove 28.

Figure 4C:
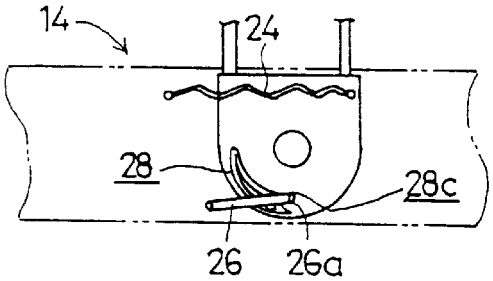

In FIG. 4*c*, when the AC plug 14 is completely raised up from the case 12 (rotating an angle of 90°), the coil spring 24 is stretched to the fullest, and the end portion 26*a* of the engagement member 26 is guided to a right end portion 28*c* of the upper-middle groove portion of the guide groove 28.

Figure 4D:
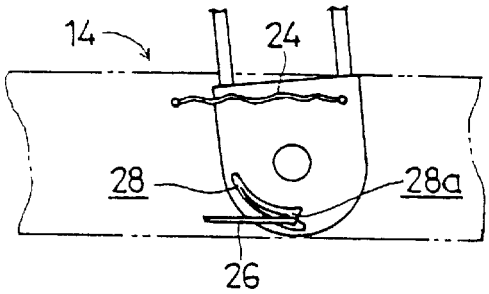

In FIG. 4*d*, if the force for keeping the AC plug 14 upright is loosened, the AC plug 14 is slightly rotated by a contracting force of the coil spring 24. At this time, the end portion 26*a* of the engagement member 26 is guided to and fixed in the heart-shaped concave portion 28*a* of the guide groove 28.

Figure 4E:
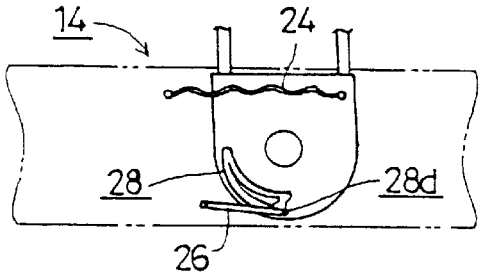

In FIG. 4*e,* when the AC plug 14 is connected to a power supply (not shown) and the electricity is turned on, the coil spring 24 is slightly stretched and thereby the AC plug 14 is completely raised upright again from the case 12 as shown in FIG. 4*c*. At this time, the end portion 26*a* of the engagement member 26 is guided to a right end portion 28*d* of a lower-middle groove portion of the guide groove 28.

Figure 4F:
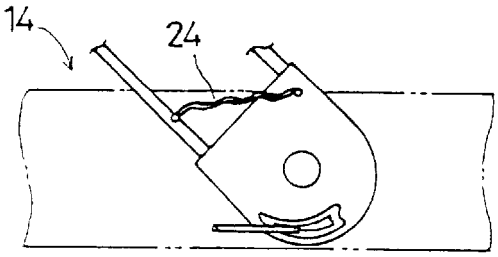

In FIG. 4*f,* if the AC plug 14 is removed from the power supply, the AC plug 14 is rotated by the contracting force of the coil spring 24. At this time, the end portion 26*a* of the engagement member 26 is guided by the lower-middle groove portion of the guide groove 28, and finally the AC plug 14 of the AC adapter 10 returns to the state shown in FIG. 4*a*. Thus, the AC plug is automatically and completely stored in the case 12.

According to the actions of the AC adapter 10 described above, when the AC plug 14 is removed from the power supply, the AC plug 14 is automatically stored again in the case 12. Hence, the AC plug 14 will not be damaged even if the AC adapter 10 collides with an object.

Next, a description will be given of an AC adapter 32 as a modification according to the embodiment of the present invention, in conjunction with FIG. 5.

A basic structure of the AC adapter 32 according to the modification is the same as that of the AC adapter 10 according to the above-described embodiment of the present invention, and therefore a description of the basic structure is omitted.

The AC adapter 32 of the modification is equipped with a coil spring 34 which functions as a force mechanism and has two end portions 34*a,* 34*b*. The end portion 34*a* is fixed in a place of a holding portion 38 of an AC plug 36 and the end portion 34*b* is fixed in a place of a case 40. It should be noted that the fixation places of the end portions 34*a,* 34*b* according to the modification are different from those of the end portions 24*a,* 24*b* according to the embodiment of the present invention. Regardless of this difference, when the AC plug 36 is raised to rotate an angle of 90° (see FIG. 5*c*), the coil spring 34 extends perpendicular to the central axis of a rotary shaft 42, and is positioned nearer to an opening-end surface 40*a* of the case 40 for raising the AC plug 36 than the central axis.

A hemispherical projection 44 is mounted in the holding portion 38 of the AC plug 36. The hemispherical projection 44 functions as a fixing mechanism for temporarily fixing the AC plug 36 in a position where the AC plug 36 is rotated an angle of approximately 90°. The hemispherical projection 44 has a corresponding hole portion 46 which is formed in the case 40.

Next, actions of the AC adapter 32 according to the modification of the present invention will be described.

Figure 5A:
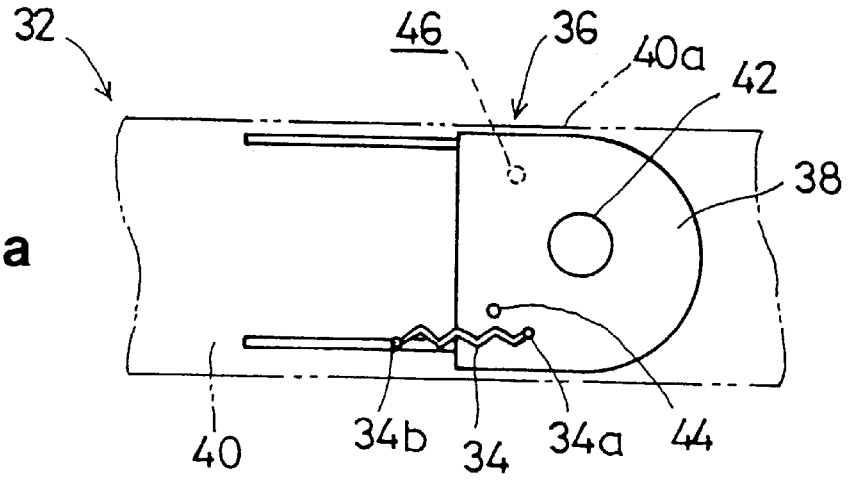
FIGS. 5*a* to 5*c* show structures and actions of an AC adapter according to a modification of the embodiment of the present invention, FIG. 5*a* showing the AC plug stored in a case, FIG. 5*b* showing the AC plug raised up and temporarily fixed on the case, FIG. 5*c* showing the AC plug connected to a power supply.

As shown in FIG. 5*a,* when the AC plug 36 is completely stored in the case 40, the coil spring 34 is in a most contracted state.

Figure 5B:
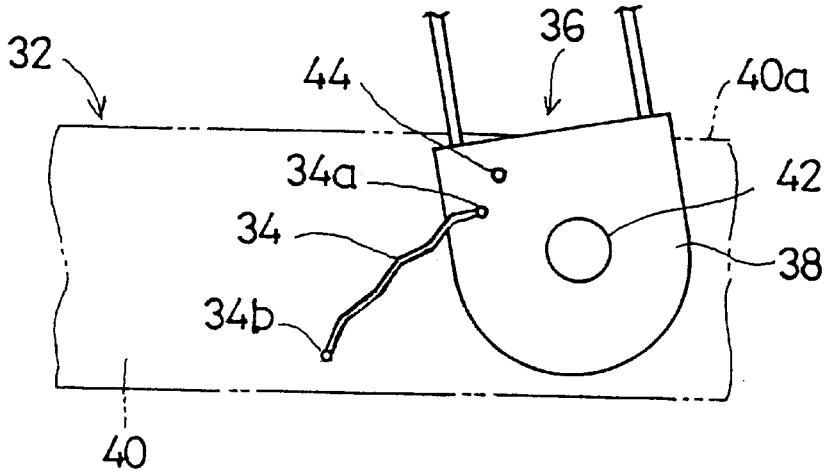

As shown in FIG. 5*b,* when the AC adapter 32 is gradually raised, the AC plug 36 is temporarily fixed by fitting the projection 44 into the hole portion 46.

Figure 5C:
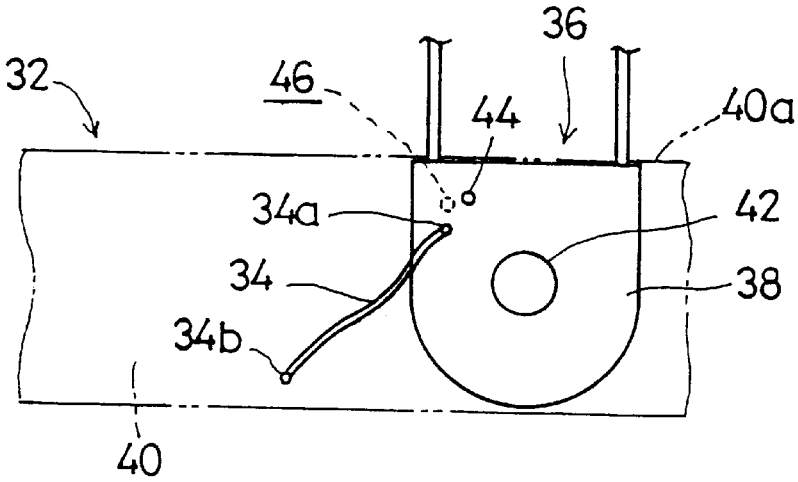

As shown in FIG. 5*c,* when the AC plug 36 in the state of FIG. 5*b,* is connected to a power supply (not shown), the projection 44 is removed from the hole portion 46 by a force generated in connecting the AC plug 36 to the power supply, and the electricity is turned on.

When the AC plug 36 is removed from the power supply, the coil spring 34 generates a contracting force which is larger than the force for keeping the AC plug 36 in the state of FIG. 5*b,* so that the AC plug 36 is stored again in the case 40 rather than being temporarily fixed by the projection 44 and the hole portion 46, that is, the AC plug 36 comes back to the state shown in FIG. 5*a*.

Accordingly, the AC adapter 32 according to the modification of the present invention can achieve the same effects as the AC adapter 10 according to the embodiment of the present invention.

Figure 6A:
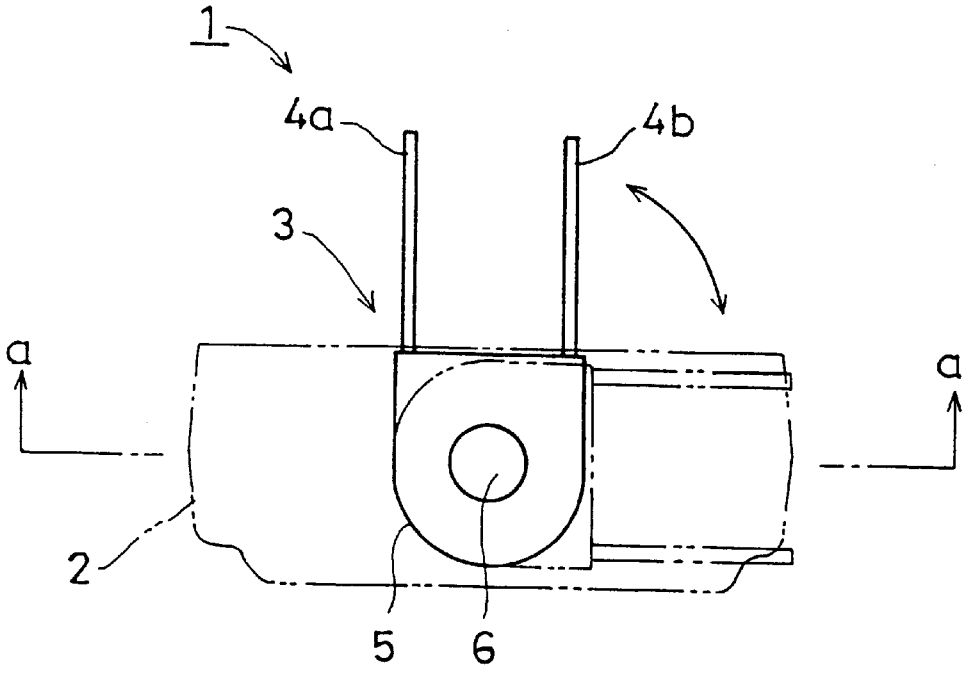
FIG.6a PRIOR ART
FIGS. 6*a* and 6*b* are views of a first example of a conventional AC adapter, FIG. 6*a* showing a schematic front view of the AC adapter, FIG. 6*b* showing a partly schematic left view of the AC adapter.
Figure 6B:
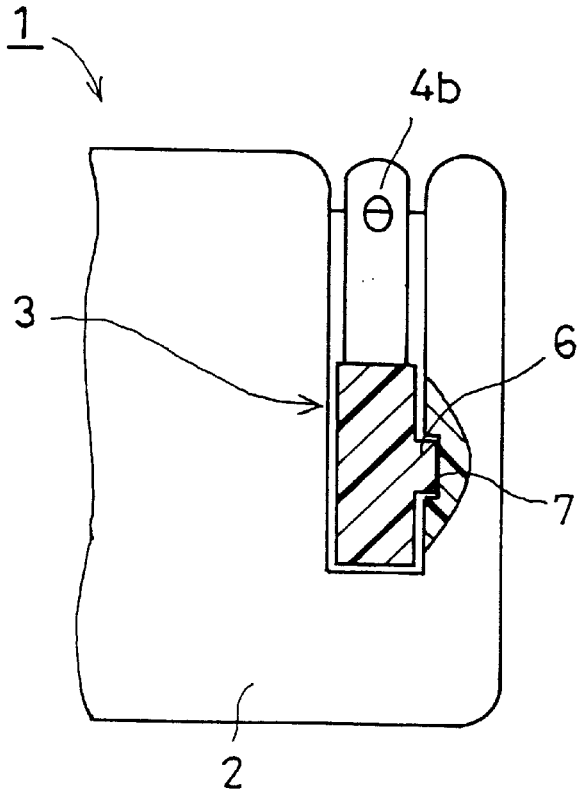
FIG.6b PRIOR ART
Figure 7:
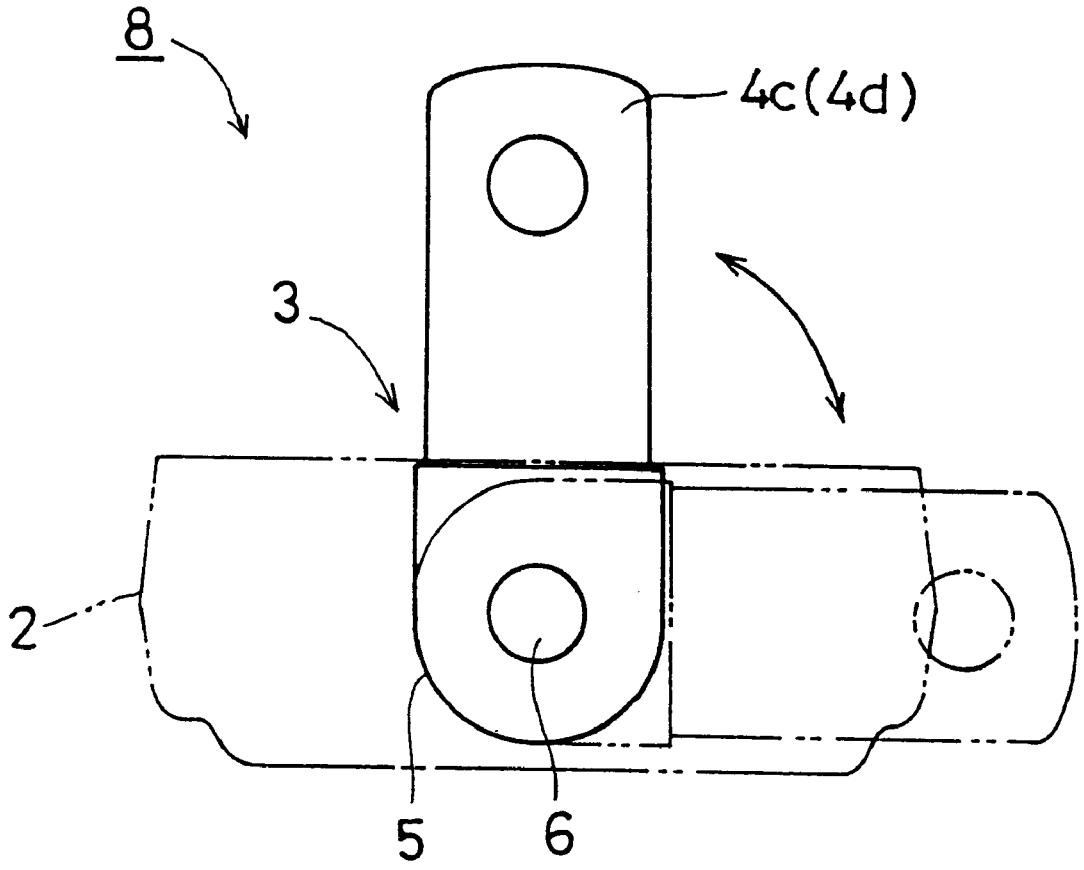
FIG.7 PRIOR ART
FIG. 7 is a schematic front view of a second example of the conventional AC adapter.

The AC adapters 10, 32 according to the embodiment and modification of the present invention each have the basic structure corresponding to the AC adapter 1 described in FIG. 6 as the prior art, and it goes without saying that the present invention can be also suitable for an AC adapter which has a basic structure corresponding to the AC adapter 8.

According to one aspect of the present invention, an electronic device with a falling type AC plug which can be rotated an angle of 90° comprises a force mechanism for constantly exerting a force on the AC plug so that the AC plug can be stored in a case of the device; and a fixing mechanism for temporarily fixing the AC plug in a position where the AC plug is raised by a rotation of nearly 90°, the AC plug being released from the fixation state by being connected to and then removed from a power supply. Hence, the AC plug will not be damaged even by a force caused by the electronic device colliding with some object.

According to another aspect of the present invention, an electronic device comprises a case; and an AC plug having blades for connecting to a power supply and a holding portion integrally formed on end portions of the blades, the AC plug being able to be rotated an angle of 90° about the case so that the AC plug can be stored in the case; an elastic member having two end portions, one end portion being fixed in the holding portion of the AC plug, the other end portion being fixed in the case, wherein when the AC plug is raised by a rotation of 90° about a rotary shaft, the elastic member extends perpendicular to a central axis of the rotary shaft and is positioned nearer to an opening end surface formed on the case for raising up the AC plug than the central axis so as to exert a torque on the AC plug about the rotary shaft; a guide groove for guiding the AC plug to rotate an angle of 90°, the guide groove having a fixing groove portion for temporarily fixing the AC plug in a position where the AC plug is rotated nearly an angle of 90°; and an engagement member having two end portions for engaging the holding portion of the AC plug with the case such that one end portion is engaged with the guide groove of the AC plug and the other end portion is engaged with a hole portion formed in the case, wherein, when the AC plug is raised up from the case, the elastic member is stretched and the engagement member is guided to the fixing groove portion via the guide groove, the AC plug being temporarily fixed in a position where the AC plug is rotated nearly 90°; when the AC plug is connected to a power supply so that the AC plug is completely rotated an angle of 90°, the engagement member is guided by the guide groove and thereby the fixation of the AC plug is released, when the AC plug is removed from the power supply, the elastic member contracts and the engagement member is guided by the guide groove, so that the AC plug can be automatically stored in the case. Hence, as described above, the present invention can achieve further improved effects.

What is claimed is:

1. An electronic device comprising a case and an AC plug that can be rotated with respect to said case, said device further comprising:

a force mechanism for constantly exerting a force on said AC plug so that said AC plug can be stored in said case; and a fixing mechanism for temporarily fixing said AC plug in a state in which said AC plug has been rotated nearly 90 degrees and releasing said AC plug from a temporarily fixed state in response to external force applied to said AC plug due to of removing said AC plug from a power supply.

2. The electronic device as claimed in claim 1, wherein said force mechanism comprises a mechanical spring.

3. The electronic device as claimed in claim 2, wherein said fixing mechanism comprises a guide groove in said AC plug, a hole portion in said case, and an engagement member that extends between the guide groove and the hole portion and that has a projection corresponding to the hole portion.

4. The electronic device as claimed in claim 2, wherein the mechanical spring is a coil spring.

5. The electronic device as claimed in claim 1, wherein said fixing mechanism includes a guide groove in said AC plug, a hole portion in said case, and an engagement member that extends between the guide groove and the hole portion and that has a projection corresponding to the hole portion.

6. The electronic device as claimed in claim 5, wherein said projection has a hemispherical shape which can be fitted into said hole portion.

7. An electronic device comprising:

a case;

an AC plug having blades for connecting said AC plug to a power supply and a holding portion integrally formed on end portions of said blades, said AC plug being able to rotate 90 degrees about said case so that said AC plug can be stored in said case;

an elastic member having two end portions, one end portion being fixed in said holding portion of said AC plug, the other end portion being fixed in said case, wherein when said AC plug is raised up by a rotation of 90 degrees about a rotary shaft, said elastic member extends perpendicular to a central axis of said rotary shaft and is positioned nearer to an opening end surface formed on said case for raising up said AC plug than the central axis;

a guide groove for guiding said AC plug to rotate 90 degrees, said guide groove having a fixing groove portion for temporarily fixing said AC plug in a position where said AC plug is rotated nearly 90 degrees; and an engagement member having two end portions for engaging said holding portion of said AC plug with said case such that one end portion of the engagement member is engaged with said guide groove of said AC plug and the other end portion is engaged with a hole portion formed in said case, wherein, when said AC plug is raised up from said case, said elastic member is stretched and said engagement member is guided to said fixing groove portion via said guide groove, said AC plug being temporarily fixed in a position where said AC plug is rotated nearly 90 degrees, when said AC plug is connected to the power supply so as to make said AC plug completely rotate 90 degrees, said engagement member is guided by said guide groove and thereby the fixed position of said AC plug is released; and when said AC plug is removed from the power supply, said elastic member contracts and said engagement member is guided by said guide groove, so that said AC plug can be automatically stored again in said case.

8. The electronic device as claimed in claim 7, wherein said elastic member comprises a coil spring.

9. The electronic device as claimed in claim 7, wherein said guide groove is shaped like a heart and said fixing groove portion of said guide groove includes a heart-shaped concave portion.

* * * * *